US005887971A

United States Patent [19]

Gandini et al.

[11] Patent Number: 5,887,971

[45] Date of Patent: Mar. 30, 1999

[54] HOMOGENIZING VALVE

[75] Inventors: Marco Gandini, Parma; Adelmo Volpi, Varano Melegari; Silvia Grasselli, Parma, all of Italy

[73] Assignee: Niro Soavi S.p.A., Parma, Italy

[21] Appl. No.: 865,004

[22] Filed: May 29, 1997

[30] Foreign Application Priority Data

Apr. 23, 1997 [IT] Italy ..... MI96 A 001103

[51] Int. Cl.[6] ..... B01F 5/08

[52] U.S. Cl. ..... 366/176.2; 366/185.4; 138/46

[58] Field of Search ..... 366/176.1, 176.2, 366/176.4, 336, 182.4, 341; 251/61.2, 61.4, 62, 63.6; 138/40, 44, 45, 46

[56] References Cited

U.S. PATENT DOCUMENTS

| | | | |
|---|---|---|---|
| 2,057,925 | 10/1936 | Smith et al. | 138/46 |
| 2,137,854 | 11/1938 | Ordway | 138/46 |
| 2,302,705 | 11/1942 | Marco | 138/46 |
| 2,504,678 | 4/1950 | Gardner | 366/176.2 |
| 2,882,025 | 4/1959 | Loo | 366/176.1 |
| 3,473,787 | 10/1969 | Barlett | 366/176.2 |

FOREIGN PATENT DOCUMENTS

| | | |
|---|---|---|
| 384 984 | 11/1923 | Germany . |
| 37 28 946 | 3/1989 | Germany . |
| 420 437 | 5/1933 | United Kingdom . |
| 476 556 | 2/1937 | United Kingdom . |
| 528 019 | 4/1939 | United Kingdom . |

*Primary Examiner*—Tony G. Soohoo
*Attorney, Agent, or Firm*—Sixbey, Friedman, Leedom & Ferguson; Frank P. Presta; Joseph S. Presta

[57] ABSTRACT

In a homogenization unit, a homogenizing valve comprises an impact head which, with a lower valve body, forms an annular high-pressure chamber (64) supplied by a high pressure channel (24). An annular surface of the impact head cooperates with an opposite face of a passage head (22) accommodated in the lower valve body to define a radial passage gap, with an impact ring facing it; the gap leads into a low-pressure annular chamber (54) from which a low pressure channel (34) leads off. The impact head comprises two spaced out guide areas to guide the head in the valve body.

5 Claims, 2 Drawing Sheets

HOMOGENIZING VALVE

BACKGROUND OF THE INVENTION

The invention relates to the field of homogenizing units.

A homogenization process is used to reduce the size of the drops in an emulsion or the particles in a suspension and make them as homogeneous or equal to each other as possible. The homogenization process generally comprises the passage (forcing or blow-by) of a liquid to be homogenized through a nozzle or a very fine opening or gap, under a suitable pressure, in order to cause impacts and breaking down of the particles; in addition the flow of particles leaving said passage at high speed is caused to hit a so-called impact ring, which further contributes to reducing particle size and improving homogenization.

Homogenizer units currently in use comprise a homogenizing valve downstream of a compression head whose function is to pump liquid to be homogenized at high pressure; said liquid is introduced, generally axially, through said valve into a pressure chamber defined by an impact head, which is pressed with adjustable force towards an opposite surface of an annular passage head, which is fixed in the valve body. Such a homogenizing valve according the state of the art is shown schematically in axial sectional view in FIG. 1. In this figure, reference number 1 indicates a high pressure chamber in lower valve body 2 into which the liquid to be homogenized is introduced in the direction of the arrow F1 at high pressure up to over 1000 bar; the high pressure chamber has a diameter D1. Said lower valve body 2 houses a passage head 3 with which an impact head 4 cooperates pressed with adjustable force by guiding and pressing shaft 5. The impact head is guided by fixed radial wings 6 integral with upper valve body 7. The product at high pressure which is forced to pass through a radial passage gap (height h1) between the impact head 4 and the passage head 3 loses pressure and gains velocity, and hits at high speed against impact ring 8, said ring being housed in the upper valve body 7 and facing the radial passage gap. The homogenized liquid passes along the radial wings 6 into a low pressure chamber 9 and flows out in the direction of arrow F2.

This arrangement is widely used. However, in the radial passage gap between the impact head and the passage head, the velocity of the fluid is not evenly distributed across the height of the passage gap and this results in differences in homogenization in the various layers of fluid. In addition, turbulence and cavitation occur, these phenomena increasing with the height of the gap. On the other hand, if the height of the gap were reduced, which could be advantageous for improving the particle size distribution of the product to be processed, with the same flow and homogenization pressure applied, it would be necessary to construct a valve with a larger diameter D1 (FIG. 1) and this would involve having to apply a considerably greater force to the impact head to obtain the same homogenization pressure. This would therefore result in a greater mechanical complexity of the equipment, the presence of a high pressure hydraulic control system and consequently higher costs.

SUMMARY OF THE INVENTION

An aim of the inventors was to improve the homogenization efficiency, which means maintaining the quality of the product constant, decreasing the pressure applied or, with the same pressure conditions, improving the quality of the end product. An indication of the efficiency of homogenization and micronization, due to passage through the homogenizing valve, is given by the particle distribution: in a plane having the percentage of particles in volume or in number on the ordinate and the diameter of the particles on the abscissa, the majority of the particles must be of equal size, or as similar as possible, and in any case smaller than the initial condition.

A further aim is to improve the impact head guide and support, in order to decrease noise and vibrations.

These aims have been achieved with a valve unit as stated in claim 1; further new and advantageous characteristics are stated in the subsequent claims.

The new homogenizing valve unit comprises a lower valve body and an upper valve body. In the valve body a high pressure chamber is annular in shape and a lower surface of the impact head on which pressure acts is also annular. The impact head preferably has opposite, facing surfaces extending in an annular shape around a central body. Said impact head is guided in its seat in two axially spaced positions. A high pressure fluid inlet channel is preferably radial in the lower valve body and a low pressure outlet channel is radial in the upper valve body.

Since the new homogenizing valve leads to an improvement in homogenization efficacy with respect to the previous valves and therefore allows homogenization pressure to be lowered whilst maintaining the same effect, its use implies substantial energy savings. Furthermore the valve works under better mechanical conditions, in that the impact head is guided at two points (whereas in previous units the impact head was cantilevered) therefore there is greater stability. Since the fluid velocities are lower, fluid dynamics conditions are improved, resulting in a reduction in noise, vibrations, and wear on valve components, and a decrease in turbulence and cavitation. The manufacturing cost of the new valve is lower, since the valve is composed of a smaller number of parts, easier to make than conventional valves; the new valve also requires less maintenance.

Furthermore, in the new valve, the fact that there is pressure compensation on the facing surfaces of the impact head reduces the problems related to the fact that the fluid is necessarily delivered to the valve at a flow rate that is not constant; this was previously overcome with an oleo gear system which, however, was relatively complex and costly. In the new valve it is sufficient to provide a shock absorber spring whilst a pneumatic cylinder to apply force to the impact head is directly coupled to the impact head.

BRIEF DESCRIPTION OF THE DRAWINGS

Further characteristics and advantages of the invention will be made clearer by the detailed description with reference to the appended drawings, in which.

DETAILED DESCRIPTION OF THE PREFERRED EMBODIMENTS

Figure 1:
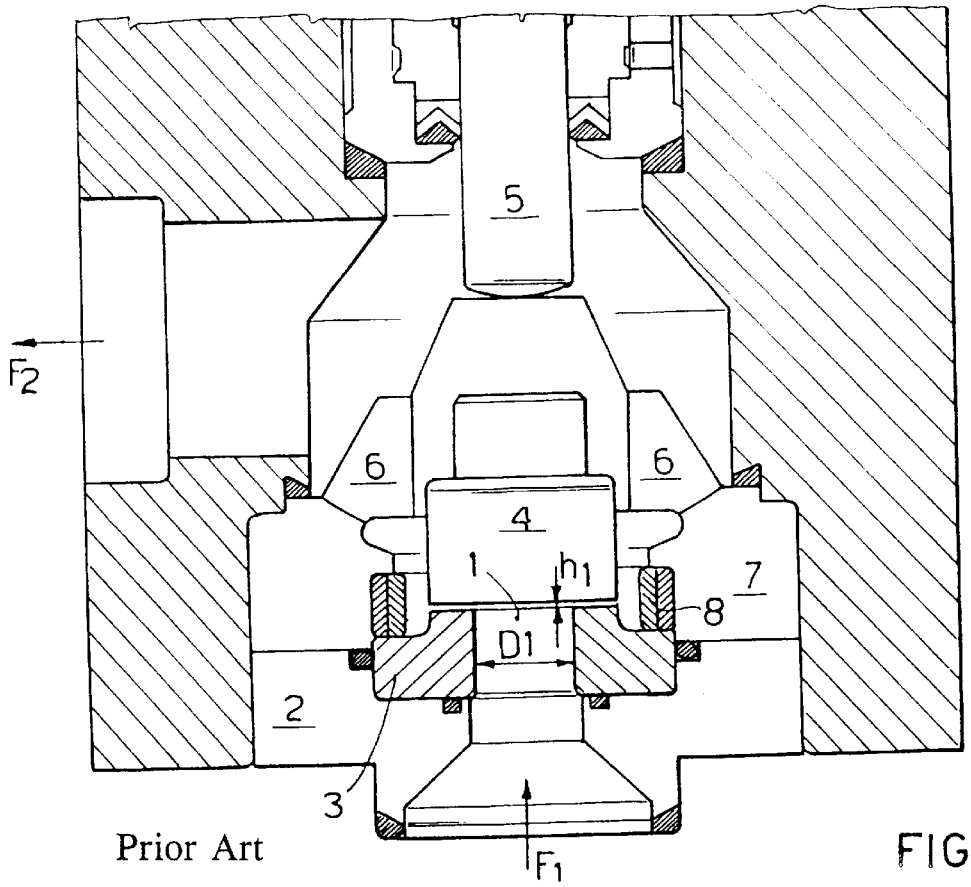
Prior Art FIG. 1
FIG. 1 is a schematic axial section, interrupted, of a homogenizing valve according to the state of the art prior to this invention.
Figure 2:
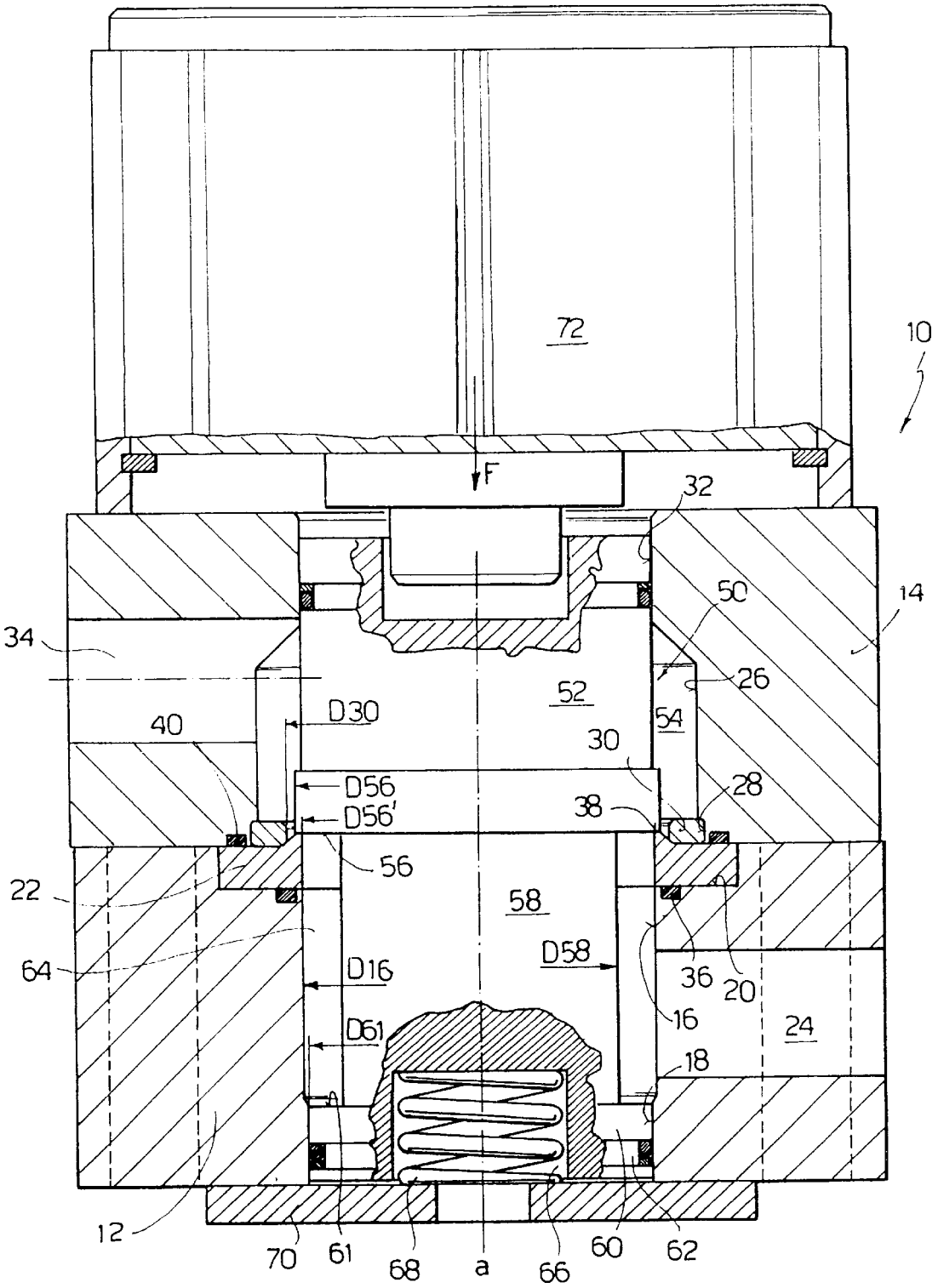
FIG. 2 is an axial sectional view of an unrestrictive embodiment of a homogenizing valve according to this invention.

A prior art valve shown in FIG. 1 has been described above. A new valve of the invention will now be described with reference to FIG. 2.

The new homogenization valve is indicated as a whole with reference number 10. It comprises a valve structure comprising a lower valve body 12 and an upper valve body 14.

The lower valve body 12 has a bore 16 with a diameter D16 that extends downwards forming a bore 18 with a diameter D18. The bores 16 and 18 define a common axis indicated by a. Above the bore 16 the lower valve body has a housing 20 coaxial with the bores 16, 18 and with a larger diameter, to accommodate a passage head 22 which will be explained below.

The bore 16 communicates with a radial feed channel 24.

The upper valve body 14 has a bore 26 with a diameter D26, which, when the upper valve body is mounted on the lower valve body, is also aligned along the axis a. The bore 26 has a larger lower housing 28 for a (possible) impact ring 30, that will be explained below. The bore 26 narrows at the top forming a guide bore 32 with a diameter D32. The bore 26 communicates for fluid passage with a radial outlet channel 34.

The passage head 22 is accommodated in the housing 20, possibly with an O-ring 36; it has an inner surface substantially level with the inner surface of the bore 16 and has a raised seat 38 on the upper part having a reduced radial size. The upper valve body 14 is applied with a tight seal on the lower valve body, for example with an O-ring 40, and between them is accommodated the impact ring 30 that defines an inner diameter D30 slightly larger than D16 and smaller than D26.

An impact head of the homogenizing valve 10 is indicated as a whole with reference number 50, is shown in a lateral part-sectional view, and comprises an impact head body 52 that, with the bore 26, defines a low-pressure annular chamber 54. In addition the body 52 has an annular surface 56, transversal to the axis a, with a diameter D56. The diameter D56 is substantially equal to the outer diameter of the seat 38 of the passage head.

A lower extension of the impact head is indicated by 58 (diameter D58), extends coaxially to the body 52 and has an end widened part 60 that engages slidingly in the bore 18 and has an O-ring 62. The part 60 has a pressure surface 61 facing the surface 56.

A high pressure chamber 64 is defined between the extension 58, the surface of the bore 16 and the surfaces 61 and 56, and communicates with the channel 24. A lower cavity 66 is provided in the extension of the impact head and accommodates a pressure absorber spring 68, retained by a closing plate 70 fixed to the lower valve body. In the top part reference 72 is a per se known device, generally a hydraulic or pneumatic cylinder, for applying a force to the impact head. It will be seen that the impact head 50 is guided with the upper part of head body 52 in the bore 32 above, and below with head part 60 in the bore 18; that is to say, it is guided in two positions spaced out along the axis a.

The surface 56 extends radially to cover the surface 38 of the passage head, with which it cooperates. The area of the surface 56 left free by the surface 38 has a diameter indicated by D56', equal to D16. The surface 61 facing the surface 56 has a diameter D61.

The following relations exist according to the invention

D56>D16>D61>D58

Operation of homogenizing valve 10 will now be described.

A fluid to be homogenized, at high pressure, is delivered into high-pressure annular chamber 64 through channel 24. The pressure applied to the fluid can vary. and is chosen on the basis of the type of fluid according to the specific homogenization requirements for each product. The fluid under pressure in the chamber 64 applies pressure p on the surface 61 and an identical but opposite pressure on the surface 56. Since the area of the surface 61 exposed to pressure is equal to $$\pi\frac{(D_{61})^2}{4}-\pi\frac{(D_{58})^2}{4}$$

and the area of the surface 56 exposed to pressure is equal to $$\pi\frac{(D_{16})^2}{4}-\pi\frac{(D_{58})^2}{4},$$

a resulting upward force is $$F_1=\left\{\frac{\pi}{4}\cdot(D_{16}^2-D_{61}^2)\right\}p$$

which, in conditions of equilibrium, is opposed by force F applied by the device 72. In conditions of equilibrium, the impact head is separated from the surface 38 of the passage head by a distance h10 (height of the radial gap through which liquid is forced to pass). When passing through said gap, the liquid undergoes a sharp pressure drop and a sharp increase in velocity, and then hits impact ring 30. This succession of sharp change in velocity, impact, and turbulence causes homogenization of the liquid which then fills the annular chamber 54 and is directed towards the outlet through channel 34.

It will be noted that pressurised liquid is forced to pass, at least according to a schematization, across a cylindrical surface with a diameter D16 and height h10. For a given flow rate, since D16 can be made large with respect to D1 of conventional valves, the height h10 can be kept relatively small, much smaller than h1 of conventional valves, thus improving the homogenization efficiency. With the valve of the present invention it is possible to obtain remarkably large diameters D1 6 in that the thrust force that the fluid applies to the impact head (and which the device 72 must therefore oppose) is due only to the pressure exerted on the annulus defined between the diameters D16 and D61, thus on a rather thin annulus. In prior art units, having a same impact head diameter, the force applied by the fluid to the impact head was equal to the fluid pressure multiplied for the entire area of the impact head and was therefore considerably greater.

Figure 3:
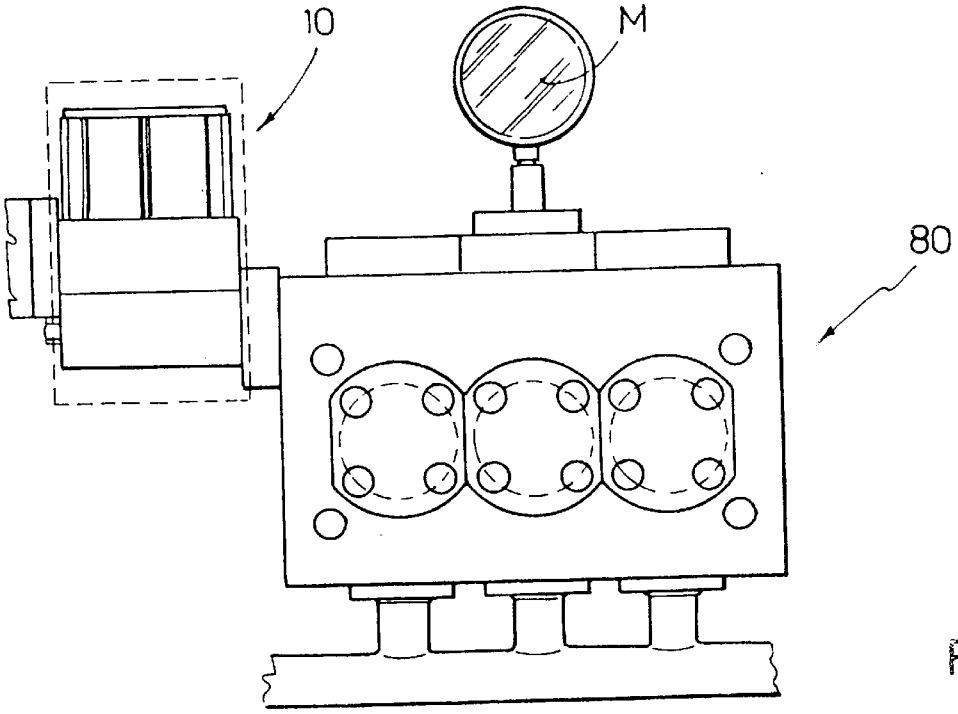
FIG. 3 is a schematic side view of a homogenizer unit comprising a homogenizing valve according to the present invention.

FIG. 3 shows the valve 10 of the invention mounted downstream of a three-piston compression head referenced 80 as a whole; the three pistons are referenced 81, 82 and 83.

We claim:

1. A homogenizing valve comprising a valve structure including a first valve body and an second valve body; a first bore (16) in the first valve body (12) communicating with an inlet channel (24) for high pressure liquid to be homogenized; a second bore (26) in the second valve body (14) communicating with an outlet channel (34) for low-pressure homogenized liquid; a passage head (22) between said first bore and second bore having a seat (38); an impact head (50) having a first pressure surface exposed to high pressure in said first bore and having a portion which cooperates with said seat, defining therewith a forcing passage gap; a thrust means (72) for the impact head; wherein said impact head comprises an extension (58) extending into said first bore (26), said impact head extension defining an annular high-pressure chamber (65), with said first bore, said first pressure surface (56) exposed to said high pressure being annular.

2. A valve according to claim 1, wherein said extension (58) of the impact head comprises a guide part (60) cooperating with a corresponding guide bore (18) in the first valve body.

3. A valve according to claim 1 wherein said impact head extension further comprises a second annular pressure surface (61) exposed to the high pressure in said first bore, said second annular pressure surface being at a distance from and facing said first annular pressure surface (56), and having a smaller outer diameter (D61) than said first pressure surface.

4. A homogenizing valve as claimed in claim 1 further comprising an impact ring around said seat and radially spaced therefrom.

5. A homogenizing valve comprising a valve structure including a valve body assembly; a first bore (16) in the valve body assembly communicating with an inlet channel (24) for high pressure liquid to be homogenized; a second bore (26) in the valve body assembly communicating with an outlet channel (34) for low-pressure homogenized liquid; a passage head (22) between said first and second bores having a seat (38); an impact head (50) having a first pressure surface exposed to high pressure in said first bore and having a portion which cooperates with said seat, defining therewith a homogenizing passage gap; a thrust means (72) for the impact head; wherein said impact head comprises an extension (58) extending in said first bore (26) said extension defining an annular high-pressure chamber with said first bore, said pressure surface exposed to high pressure being annular.

* * * * *

UNITED STATES PATENT AND TRADEMARK OFFICE

CERTIFICATE OF CORRECTION

PATENT NO. : 5,887,971
DATED : March 30, 1999
INVENTOR(S) : GANDINI et al.

It is certified that error appears in the above-identified patent and that said letters patent is hereby corrected as shown below:

Cover page, Section 30, change "April 23, 1997" to --May 30, 1996--.

Signed and Sealed this

Second Day of November, 1999

*Attest:*

Q. TODD DICKINSON

*Attesting Officer*

*Acting Commissioner of Patents and Trademarks*